US009605848B2

(12) United States Patent
Edgar et al.

(10) Patent No.: US 9,605,848 B2
(45) Date of Patent: Mar. 28, 2017

(54) CHIMNEY TEE CAP RETAINER ASSEMBLY

(75) Inventors: Glen A. Edgar, Lancaster, OH (US); Eric Wayne Palmbos, Allendale, MI (US); Brian Joseph Carroll, Hastings, MI (US)

(73) Assignee: SELKIRK CORPORATION, Grand Rapids, MI (US)

( * ) Notice: Subject to any disclaimer, the term of this patent is extended or adjusted under 35 U.S.C. 154(b) by 1115 days.

(21) Appl. No.: 13/296,289

(22) Filed: Nov. 15, 2011

(65) Prior Publication Data

US 2013/0122794 A1 May 16, 2013

(51) Int. Cl.
*F23J 13/08* (2006.01)

(52) U.S. Cl.
CPC ..... *F23J 13/08* (2013.01)

(58) Field of Classification Search
CPC F23J 13/08; F23J 2213/50; F23J 13/00; F23J 2213/101; F23J 13/04; F23L 17/12; B23K 37/053; E03C 1/262; F24B 1/191
USPC ..... 454/4, 12, 14, 35, 3, 237, 28, 339, 359, 454/361, 367, 368, 369, 38, 44, 45, 47, 5, 454/8; 126/307 R, 312, 285 B, 316, 500, 126/99 R, 307 A, 31, 318, 364.4, 38, 43, 126/44, 50, 512, 515, 522, 80, 84, 9 B, 126/314; 292/32, 41–43, 246, 248, 256, 292/256.5, 256.6, 256.67, 256.65, 256.71, 292/256.75, 258, 288, 289, 291, 293, 294, 292/295; 220/328, 327, 325, 324, 315
See application file for complete search history.

(56) References Cited

U.S. PATENT DOCUMENTS

| | | | | | |
|---|---|---|---|---|---|
| 236,921 | A | * | 1/1881 | Trollops | 126/318 |
| 1,503,647 | A | * | 8/1924 | Frautz et al. | 126/99 R |
| 1,615,909 | A | | 2/1927 | Nance | |
| 1,837,346 | A | * | 12/1931 | Thomas et al. | 220/248 |
| 2,027,113 | A | * | 1/1936 | Millinger | F24B 1/191 126/319 |
| RE21,164 | E | * | 7/1939 | Tate | 425/460 |
| 2,175,564 | A | | 10/1939 | Ingham | |
| 2,438,411 | A | * | 3/1948 | Meiller et al. | 52/218 |
| 2,524,168 | A | * | 10/1950 | Harnish, Jr. et al. | 269/297 |
| 2,552,918 | A | * | 5/1951 | Becker | 220/787 |
| 2,582,905 | A | * | 1/1952 | Harmon | 454/36 |
| 2,831,711 | A | * | 4/1958 | Leadbetter | 285/238 |
| 2,914,832 | A | * | 12/1959 | Lee | 249/183 |
| 2,936,979 | A | * | 5/1960 | Epstein | 248/57 |
| 2,946,215 | A | * | 7/1960 | Eshbaugh et al. | 70/169 |

(Continued)

*Primary Examiner* — Steven B McAllister
*Assistant Examiner* — Ko-Wei Lin
(74) *Attorney, Agent, or Firm* — Jackson Walker LLP; Christopher J. Rourk

(57) ABSTRACT

A chimney tee cap retainer assembly comprising a cap, a first member comprising a guideway extending in a longitudinal direction, the first member connectable to the cap using a first fastener, a second member having a sprung end portion, the sprung end portion for releasably engaging a chimney surface, the second member adjustably engaged with the guideway using a second fastener, a third member having a sprung end portion, the sprung end portion for releasably engaging a chimney surface, the third member adjustably engaged with the guideway using a third fastener, and the second member and the third member each having a second member portion and a third member portion each extending normal to the first member and each extending in the same axial direction.

20 Claims, 4 Drawing Sheets

(56) References Cited

U.S. PATENT DOCUMENTS 3,013,484 A * 12/1961 Sonne et al. ..... 454/368
3,200,735 A * 8/1965 Bergen ..... 454/366
3,285,289 A * 11/1966 Titus ..... 138/89
3,362,425 A * 1/1968 Morris et al. ..... 137/362
3,847,297 A * 11/1974 Baader et al. ..... 454/5
3,907,155 A * 9/1975 Smith et al. ..... 220/210
3,951,172 A * 4/1976 Flegel ..... 138/89
3,951,441 A * 4/1976 Scheuer et al. ..... 285/391
4,325,291 A * 4/1982 Paynton et al. ..... 454/14
4,366,830 A * 1/1983 Becelaere ..... 137/75
4,386,571 A * 6/1983 Dortzbach ..... 110/119
4,476,603 A * 10/1984 Lukaszewicz ..... 15/104.31
4,554,863 A * 11/1985 Dalsin ..... 454/4
4,691,624 A * 9/1987 Moore ..... 454/7
4,707,323 A * 11/1987 Vowell ..... 376/203
4,838,243 A * 6/1989 Kuber ..... 126/280
4,846,147 A * 7/1989 Townsend et al. ..... 126/307 R
5,025,712 A * 6/1991 Perry ..... 454/35
5,094,050 A * 3/1992 Jenkins ..... 52/218
5,228,882 A * 7/1993 Kraemer ..... 454/4
5,259,711 A * 11/1993 Beck ..... 410/104
5,299,884 A * 4/1994 Westhoff et al. ..... 404/25
5,556,329 A * 9/1996 VonSick ..... 454/4
5,640,999 A * 6/1997 Wood ..... 138/89
5,848,931 A * 12/1998 Dortzbach ..... 454/4
6,003,558 A * 12/1999 Neto et al. ..... 138/89
6,041,960 A * 3/2000 Leal ..... B65F 1/1615 215/306
6,164,317 A * 12/2000 Hanson ..... 137/377
6,845,815 B2 * 1/2005 Hergarden et al. ..... 166/92.1
6,887,012 B1 * 5/2005 Zappe ..... 404/25
6,918,827 B2 * 7/2005 Daniels et al. ..... 454/14
6,986,227 B1 * 1/2006 Gavin ..... 52/20
6,997,390 B2 * 2/2006 Alles ..... 236/49.4
7,134,454 B2 * 11/2006 Montminy ..... 138/89
7,159,859 B2 * 1/2007 Fuller ..... 269/170
7,232,167 B2 * 6/2007 Edwards ..... 294/95
7,427,089 B2 * 9/2008 Silverio et al. ..... 292/256.5
7,644,734 B2 * 1/2010 Palmer ..... 138/89
7,681,421 B2 * 3/2010 Cannon ..... 70/14
7,735,512 B1 * 6/2010 Ismert et al. ..... 137/362
7,798,891 B2 * 9/2010 Stubbert et al. ..... 454/44
7,896,400 B2 * 3/2011 Brill et al. ..... 285/23
8,342,210 B2 * 1/2013 Vachon et al. ..... 138/89
8,528,122 B2 * 9/2013 Ball et al. ..... 4/293
8,714,236 B2 * 5/2014 Karamanos ..... 165/11.1
9,057,519 B1 * 6/2015 Paynton et al.
2002/0160707 A1 * 10/2002 Richardson ..... 454/358
2007/0023031 A1 * 2/2007 Marek ..... 126/318
2008/0078375 A1 * 4/2008 Traina ..... F23J 13/00 126/299 D
2009/0181609 A1 * 7/2009 Thomas ..... 454/14

* cited by examiner

CHIMNEY TEE CAP RETAINER ASSEMBLY

FIELD OF THE INVENTION

The invention relates to a chimney tee cap retainer assembly, and more particularly, a chimney tee cap retainer comprising an adjustable assembly having at least two sprung members for releasably attaching the cap to a chimney tee.

BACKGROUND OF THE INVENTION

In dwelling construction, particularly with single family homes, townhouses and condominiums, there has been increasing use of factory-built, prefabricated metal chimneys for use with interior fireplaces, wood stoves, and even with normal oil or gas fired furnaces. These chimneys vent the spent gas from the fireplace, stove or furnace to the atmosphere normally at a legislated height above the roof of the residence.

Depending on the location of the fireplace, stove or furnace, these chimneys may extend horizontally through a sidewall of the dwelling before extending vertically along the outside wall of the dwelling to the predetermined height or they may extend through an interior wall of the dwelling into a utility room or attached garage before extending vertically through the roof of the dwelling. A substantial portion of the vertical portion of the chimney may be within the dwelling itself.

In either instance, it is normal procedure to support the vertical portion of the chimney with a support plate which is proximate to the position where the chimney changes direction from the horizontal to the vertical, See FIG. 1. It is also normal practice in the industry to provide for a cap or plug on the lower portion of the vertical section of a chimney known as the cleanout tee to facilitate the removal of accumulated soot and debris on a regular basis. Normal procedure is for either a frictionally-engaged end cap or plug or a cap secured by circumferential set screws to be placed at the bottom of the vertical section of the chimney, below the horizontal portion. This cap can be removed and soot and other accumulated debris can be cleaned out or can fall naturally under the influence or gravity to a container for removal.

Since the combustion process generates corrosive gases, these end caps, and in particular, the screws which secure them, deteriorate to the point where the screws rust permitting the end cap to fall off or the end cap itself deteriorates such that the end cap is capable of falling off.

If the end cap falls out the homeowner is faced with the consequences of having possible noxious and toxic fumes exit the chimney within the dwelling place. It may also subject the dwelling to a fire hazard if the cleanout tee is located proximate to the fireplace, stove or furnace such that hot gases would exit the cleanout tee, in turn igniting flammable material proximate to the chimney. This may include the exterior sidewall of the dwelling unit.

Representative of the art is U.S. Pat. No. 4,838,243 which discloses a chimney lock attachable to the support plate of a prefabricated metal chimney having vertically downwardly depending cleanouts, the cleanouts being enclosed by an end cap, the lock comprising an adjustable, planer, longitudinal bar removably or rotatably secured to the support plate and positioned to frictionally engage and secure the end cap of the chimney cleanout.

What is needed is a chimney tee cap retainer comprising an adjustable assembly having at least two sprung members for releasably attaching the cap to a chimney tee. The present invention meets this need.

SUMMARY OF THE INVENTION

The primary aspect of the invention is to provide a chimney tee cap retainer comprising an adjustable assembly having at least two sprung members for releasably attaching the cap to a chimney tee.

Other aspects of the invention will be pointed out or made obvious by the following description of the invention and the accompanying drawings.

The invention comprises a chimney tee cap retainer assembly comprising a cap, a first member comprising a guideway extending in a longitudinal direction, the first member connectable to the cap using a first fastener, a second member having a sprung end portion, the sprung end portion for releasably engaging a chimney surface, the second member adjustably engaged with the guideway using a second fastener, a third member having a sprung end portion, the sprung end portion for releasably engaging a chimney surface, the third member adjustably engaged with the guideway using a third fastener, and the second member and the third member each having a second member portion and a third member portion each extending normal to the first member and each extending in the same axial direction.

BRIEF DESCRIPTION OF THE DRAWINGS

The accompanying drawings, which are incorporated in and form a part of the specification, illustrate preferred embodiments of the present invention, and together with a description, serve to explain the principles of the invention.

DETAILED DESCRIPTION OF THE PREFERRED EMBODIMENT

The inventive device generally comprises formed stainless steel components and fasteners that enable the user to assemble the tee cap retainer to a desired dimension then install it on a chimney tee by simply pressing the assembly on the tee until it snaps in place. Later removal for inspection and cleaning of the chimney is accomplished by simply inserting the blade of a small screw driver, or similar pry tool, under one of the sprung members on either side of the assembly, then prying up the member and pulling on the eye-bolt until the assembly disengages from the chimney tee.

Figure 1:
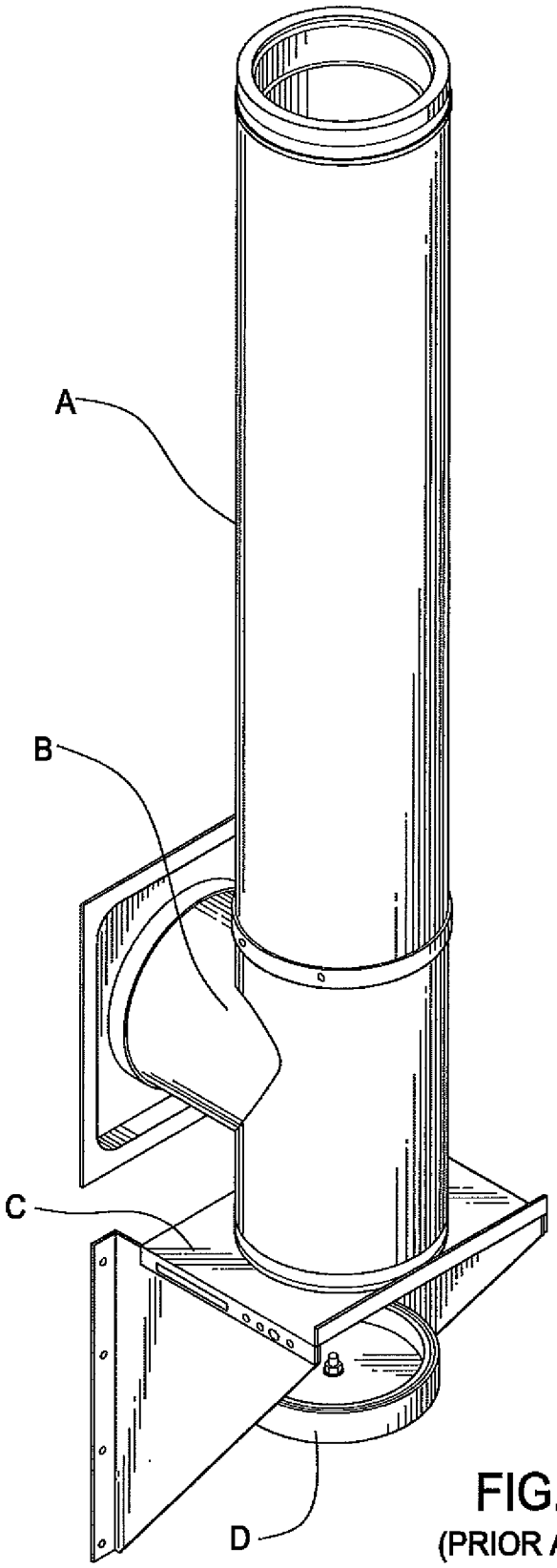
FIG.1 (PRIOR ART)
FIG. 1 is a perspective view of the prior art.

FIG. 1 is a perspective view of the prior art, which illustrates a typical factory-built chimney system (A) with chimney tee section (B) at the bottom of the stack. The chimney system "stack" rests upon a support plate assembly (C). The tee cap (D) is secured to the bottom of the tee with clips or similar devices which are then attached to the bottom of the support plate (C).

Figure 2:
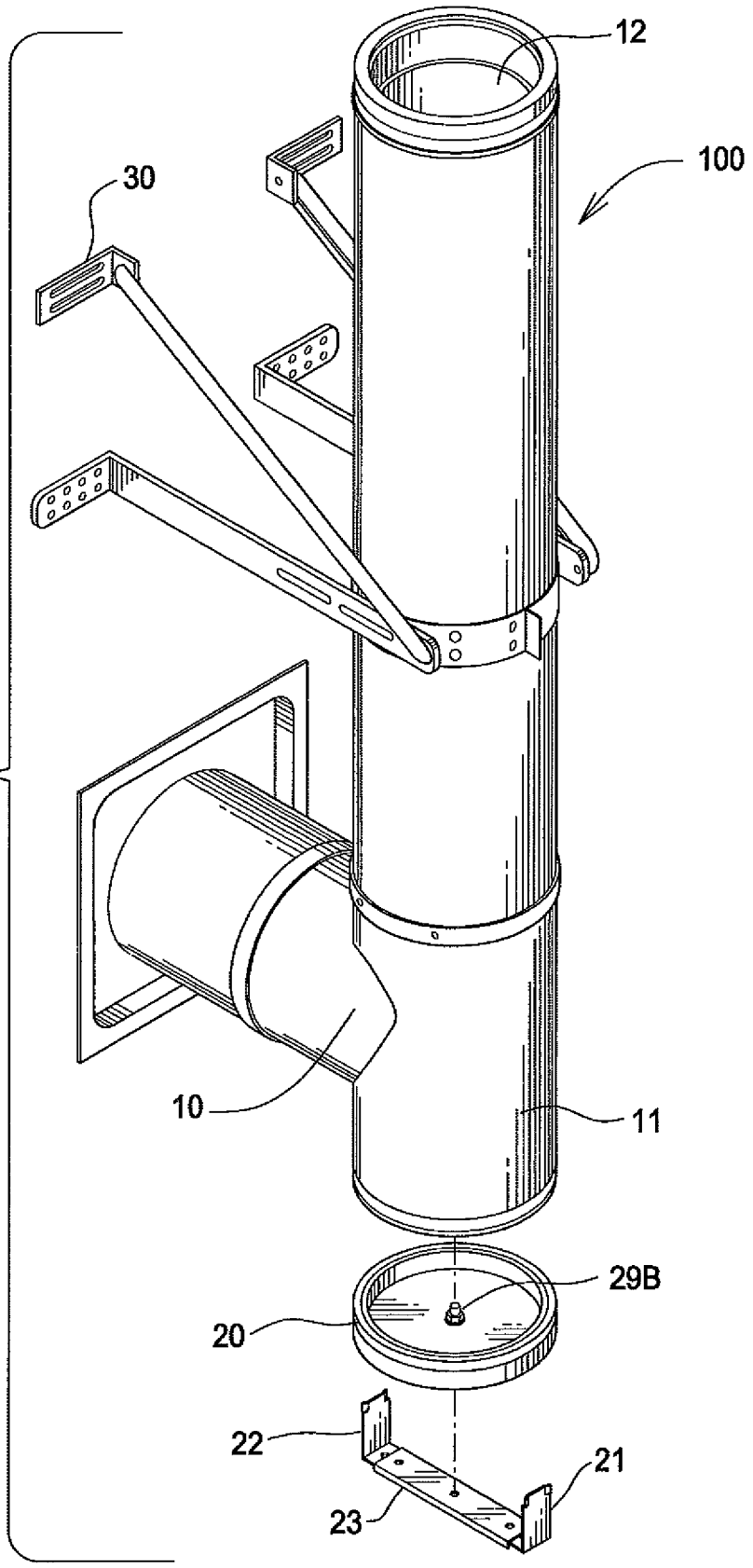
FIG. 2 is a perspective view of the inventive device.

FIG. 2 is a perspective view of the inventive device, namely, a chimney system 100 with tee section 10 at the bottom of the stack. The chimney is hung or supported from above using a bracket 30. Bracket 30 is fastened to the chimney stack and to an adjacent building (not shown).

Since the bracket 30 is located remotely from the chimney tee 10, it is not possible to use the bracket 30 to secure the tee cap 20 to the tee. Hence, without the inventive device it would otherwise be necessary to drill a series of holes through the outer wall of the chimney tee to secure the tee cap 20. Of course, holes in the chimney are undesirable since they would allow moisture to migrate inward, it would be time consuming to remove and realign the holes during installation, and in certain cases may allow flue gases to exit through the holes.

Figure 3:
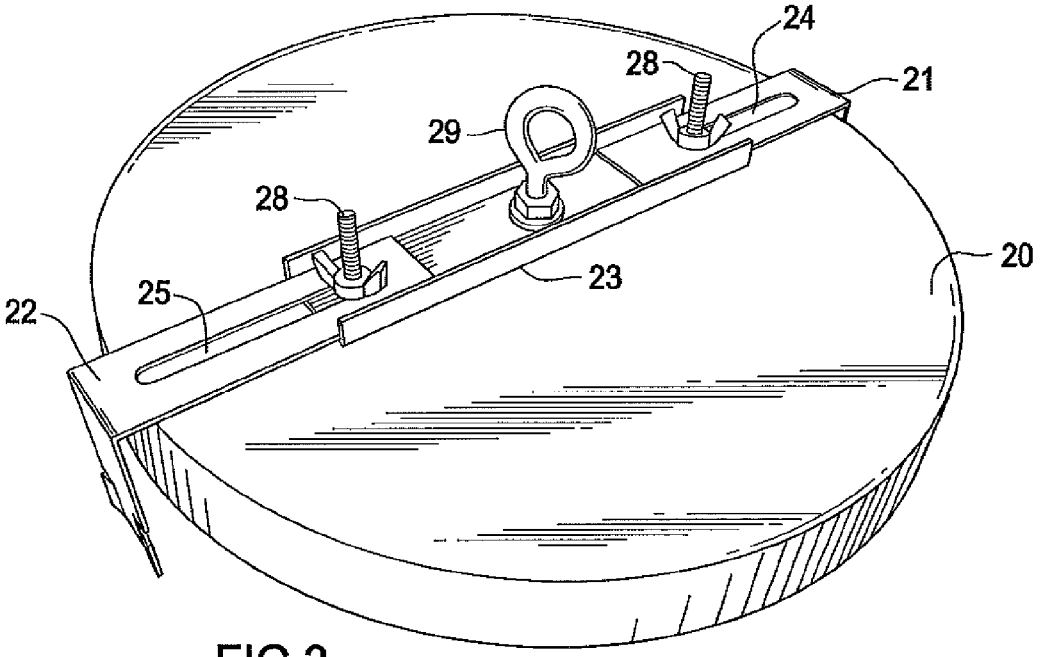
FIG. 3 is a perspective view of the cap with the device attached.

FIG. 3 is a perspective view of the cap with the device attached. The inventive device comprises a set of right angle brackets 21, 22 or 21A, 22A. Each right angle bracket comprises a slot 24, 25 respectively. Each slot allows adjustment of each right angle bracket so each can be used with different chimney diameters.

Each end portion 26 (or 26A) and end portion 27 (or 27A) of each right angle bracket comprises a predetermined shape which allows the tee cap to be attached to the chimney tee section by gripping either the inside surface 12 or outside surface 11 of the tee. Both sets of brackets can be provided with the cap assembly but only one is used depending upon the construction and configuration of the chimney joint design.

The assembly further comprises a C-shaped channel member 23 with threaded studs 28 and a hole 29A. The channel member is attached to the cap 20 with an Eye-bolt 29 and nuts 29B. Fasteners such as stud bolts 28, having wing (or regular hex) nuts 28A secure the brackets 21 and 22 to the channel. The C-shaped channel member 23 acts as a longitudinal guideway to keep the brackets in alignment and provides a stiff span length across the bottom of the cap to keep the cap securely in place without bending or distortion.

Figure 4:
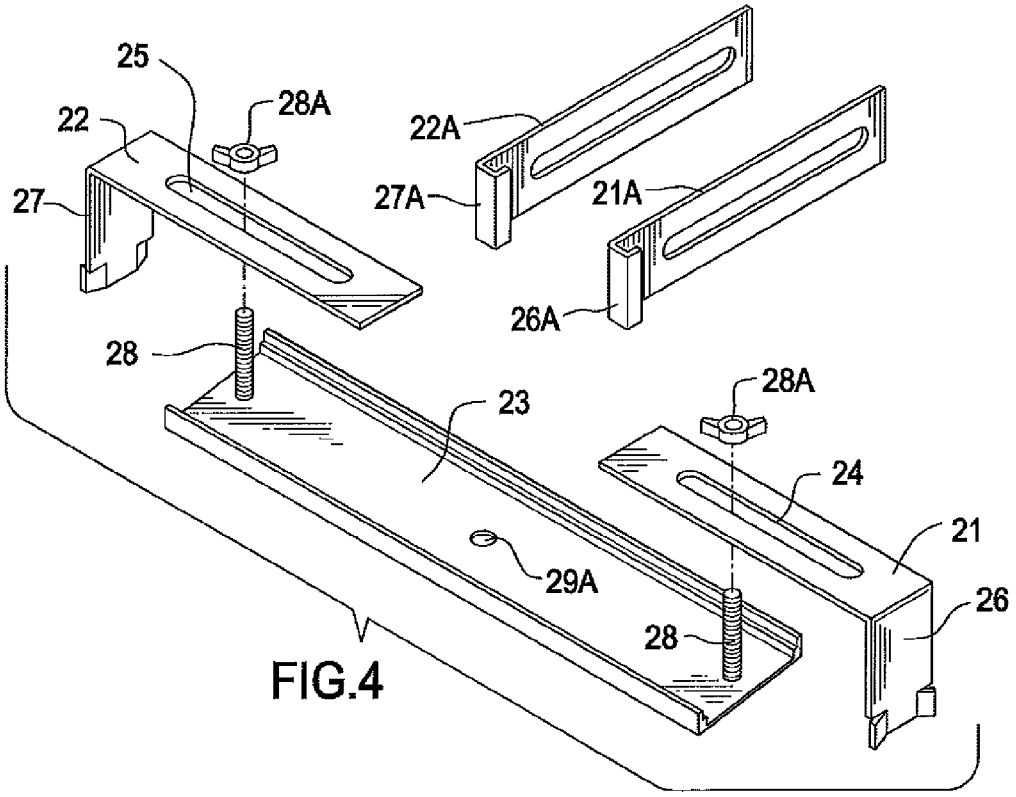
FIG. 4 is an exploded view of a partial assembly.

FIG. 4 is an exploded view of a partial assembly with an alternate embodiment. Right angle brackets 21A and 22A have ends 26A and 27A respectively. Brackets 21A and 22A are configured to allow the cap 20 to be installed by engaging ends 26A and 27A with the outside surface 11 of tee 10. In the alternate embodiment right angle brackets 21A, 22A replace brackets 21, 22.

Figure 5:
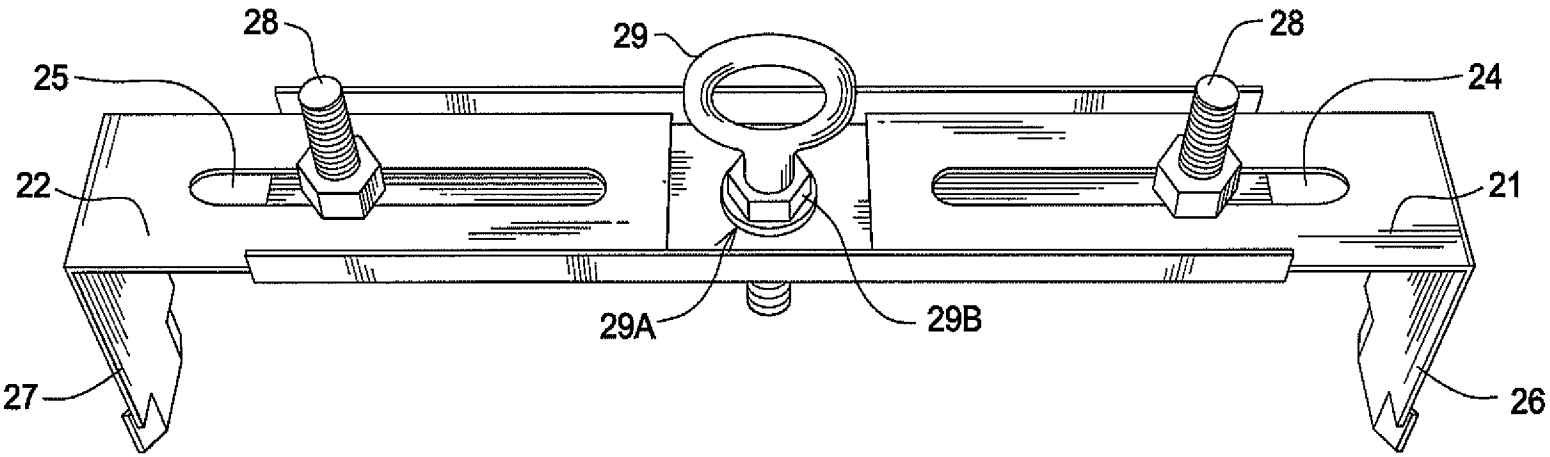
FIG. 5 is a perspective view of the assembly without the cap.

FIG. 5 is a perspective view of the assembly without the cap. To assemble the device, each longitudinal slot 24, 25 in each bracket 21, 22 is engaged with the respective stud 28 and secured. Ends 26, 27 of the respective right angle brackets are each set at the desired spacing (diameter) to accommodate the diameter of the chimney tee to which it is being installed. An eye-bolt 29 is inserted through a hole 29A in the channel member 23 and inserted through the cap 20, and secured in place with bolts 29B on each side as shown in FIGS. 2 and 3. Eye-bolt 29 mechanically secures the channel member 23 and brackets 21, to the cap 20 and also provides a pull handle to facilitate removal of the cap.

Although a form of the invention has been described herein, it will be obvious to those skilled in the art that variations may be made in the construction and relation of parts without departing from the spirit and scope of the invention described herein.

We claim:

1. A chimney tee cap retainer assembly comprising:

a cap;

a first member comprising a C-shaped channel guideway, the first member connectable to the cap using a first fastener;

a second member having a first sprung end portion, the first sprung end portion configured to releasably engage a chimney surface;

the second member adjustably engaged with the guideway using a second fastener;

a third member having a second sprung end portion, the second sprung end portion configured to releasably engage the chimney surface;

the third member adjustably engaged with the guideway using a third fastener; and the second member and the third member having a respective second member portion and a third member portion, each extending normal to the first member and each extending parallel to the chimney surface when installed.

2. The chimney cap retainer assembly as in claim 1, wherein the first fastener comprises an eye bolt.

3. The chimney cap retainer assembly as in claim 1, wherein the second fastener and the third fastener each comprise a nut and bolt assembly disposed in a slot.

4. The chimney cap retainer assembly as in claim 1, wherein the second member and the third member are each flat.

5. The chimney cap retainer assembly as in claim 1, wherein the second member and the third member are each flat and engage a chimney exterior surface.

6. The chimney cap retainer assembly as in claim 1, wherein the second fastener comprises a nut and bolt assembly.

7. The chimney cap retainer assembly as in claim 1, wherein the second fastener comprises a nut and bolt assembly disposed in a slot.

8. The chimney cap retainer assembly as in claim 1, wherein the second fastener comprises a nut and bolt assembly disposed in a slot and the third fastener comprises a nut and bolt assembly.

9. The chimney cap retainer assembly as in claim 1, wherein the second member is flat and the second fastener comprises a nut and bolt assembly.

10. The chimney cap retainer assembly as in claim 1, wherein the second member and the third member are each flat, and the second fastener comprises a nut and bolt assembly.

11. The chimney cap retainer assembly as in claim 1, wherein the second member and the third member are each flat, and the second fastener comprises a nut and bolt assembly disposed in a slot.

12. The chimney cap retainer assembly as in claim 1, wherein the second member and the third member are each flat, the second fastener comprises a nut and bolt assembly disposed in a slot, and the third fastener comprises a nut and bolt assembly.

13. The chimney cap retainer assembly as in claim 1, wherein the second member is flat and engages a chimney exterior surface and the second fastener comprises a nut and bolt assembly.

14. The chimney cap retainer assembly as in claim 1, wherein the second member and the third member are each flat and engage a chimney exterior surface, and the second fastener comprises a nut and bolt assembly.

15. The chimney cap retainer assembly as in claim 1, wherein the second member and the third member are each flat and engage a chimney exterior surface, and the second fastener comprises a nut and bolt assembly disposed in a slot.

16. The chimney cap retainer assembly as in claim 1, wherein the second member and the third member are each flat and engage a chimney exterior surface, the second fastener comprises a nut and bolt assembly disposed in a slot, and the third fastener comprises a nut and bolt assembly.

17. The chimney cap retainer assembly as in claim 1, wherein the second member engages a chimney exterior surface and the second fastener comprises a nut and bolt assembly.

18. The chimney cap retainer assembly as in claim 1, wherein the second member and the third member each engage a chimney exterior surface, and the second fastener comprises a nut and bolt assembly.

19. A chimney tee cap retainer assembly comprising:

a cap;

a first member comprising a C-shaped channel guideway, the first member connectable to the cap using a first fastener;

a flat second member having a first sprung end portion, the first sprung end portion configured to releasably engage a chimney surface;

the second member adjustably engaged with the guideway using a second fastener;

a third member having a second sprung end portion, the second sprung end portion configured to releasably engage an exterior chimney surface;

the third member adjustably engaged with the guideway using a third fastener; and the second member and the third member having a respective second member portion and a third member portion, each extending normal to the first member and each extending parallel to the chimney surface when installed.

20. A chimney tee cap retainer assembly comprising:

a cap;

a first member comprising a C-shaped channel guideway, the first member connectable to the cap using a first fastener;

a flat second member having a first sprung end portion, the first sprung end portion configured to releasably engage an exterior chimney surface;

the second member adjustably engaged with the guideway using a second fastener;

a flat third member having a second sprung end portion, the second sprung end portion configured to releasably engage a chimney surface;

the third member adjustably engaged with the guideway using a third fastener; and the second member and the third member having a respective second member portion and a third member portion, each extending normal to the first member and each extending parallel to the chimney surface when installed.

* * * * *